United States Patent [19]

Ziemba

[11] 4,386,568

[45] Jun. 7, 1983

[54] DETONATOR ASSEMBLY

[75] Inventor: Richard T. Ziemba, Burlington, Vt.

[73] Assignee: General Electric Company, Burlington, Vt.

[21] Appl. No.: 184,587

[22] Filed: Sep. 5, 1980

[51] Int. Cl.[3] ..... F42C 19/08

[52] U.S. Cl. ..... 102/204

[58] Field of Search ..... 102/204, 205, 275.9, 102/275.11, 202.5, 202.8, 202

[56] References Cited

U.S. PATENT DOCUMENTS

| | | | |
|---|---|---|---|
| 2,652,775 | 9/1953 | Swanson | 102/204 |
| 3,483,822 | 12/1969 | De Leonardis | 102/79 |
| 3,563,178 | 2/1971 | Caples | 102/86.5 |
| 3,608,493 | 9/1971 | Aske et al. | 102/78 |
| 3,616,755 | 11/1971 | Davis | 102/73 A |
| 3,715,988 | 2/1973 | Bares | 102/80 |
| 3,807,309 | 4/1974 | Evans | 102/86.5 |
| 3,919,941 | 11/1975 | Breed et al. | 102/78 |
| 3,995,557 | 12/1976 | Engel et al. | 102/79 |
| 4,018,164 | 4/1977 | Breed et al. | 102/78 |

FOREIGN PATENT DOCUMENTS

| | | | |
|---|---|---|---|
| 2648137 | 4/1978 | Fed. Rep. of Germany | 102/202.5 |
| 569127 | 5/1945 | United Kingdom | 102/204 |
| 1274632 | 5/1972 | United Kingdom . | |
| 1593677 | 7/1981 | United Kingdom | 102/202.5 |

*Primary Examiner*—Charles T. Jordan

*Attorney, Agent, or Firm*—Bailin L. Kuch

[57] ABSTRACT

A feature of this invention is the provision of detonator assembly comprising a pair of face to face opposed, longitudinally aligned and spaced apart detonators, and an initiator disposed therebetween.

7 Claims, 11 Drawing Figures

DETONATOR ASSEMBLY

RELATED APPLICATION

Subject matter disclosed but not claimed in this application is claimed in Ser. No. 184,605 filed Sept. 5, 1980 by R. T. Ziemba.

BACKGROUND OF THE INVENTION

1. Field of the Invention

This invention relates to a detonator assembly for a fuze for a projectile for a round of ammunition. It has especial utility in a base fuze for a projectile.

2. Description of the Prior Art

Exemplary base fuzes are shown in U.S. Pat. No. 3,616,755 issued to D. M. Davis on Nov. 2, 1971 and U.S. Pat. No. 3,995,557 issued to W. Engel et al. on Dec. 7, 1976. In these fuzes a rotor has a diametral bore holding a detonator and a firing pin which is aft of and is spring biased away from the rotor. The rotor initially holds the detonator out of line with the firing pin. After the application of setback and centrifugal forces, the rotor is freed to precess until the detonator is aligned with the firing pin. Upon impact, an interior mass disposed aft of the firing pin forces the pin forward to stab the detonator, causing the detonator to ignite. An exemplary detonator is shown in U.S. Army Ordnance Drawing 8798331 and identified as Detonator Stab, M-55. The detonator is similar to some extent to the primers shown in U.S. Pat. No. 3,807,309 issued to E. L. Evans on Apr. 30, 1974 and U.S. Pat. No. 3,563,178 issued to A. S. Caples on Feb. 16, 1971. Fuzes may contain a dampening fluid or material as shown in U.S. Pat. No. 3,608,493 issued to R. L. Aske on Sept. 28, 1971; U.S. Pat. No. 3,919,941 issued to Breed et al. on Nov. 18, 1975; and U.S. Pat. No. 4,018,164 issued to Breed et al. on Apr. 19, 1977. The rotor may contain two primers. In U.S. Pat. No. 3,483,822 issued to A. J. DeLeunardis on Dec. 16, 1969, one or the other primer will be stabbed by a respective external firing pin, depending on which pin is aft of the rotor upon impact. In U.S. Pat. No. 3,715,988 issued to R. Bares on Feb. 13, 1973, an external firing pin stabs a primary detonator in the rotor, which ignites and detonates a secondary detonator in the rotor, which in turn ignites to detonate a secondary booster.

SUMMARY OF THE INVENTION

It is an object of this invention to provide a detonator assembly which, when armed and functional, will propagate an explosive output both fore and aft along the axis of the projectile.

A feature of this invention is the provision of detonator assembly comprising a pair of face to face opposed, longitudinally aligned and spaced apart detonators, and an initiator disposed therebetween.

DESCRIPTION OF THE INVENTION

Figure 5:
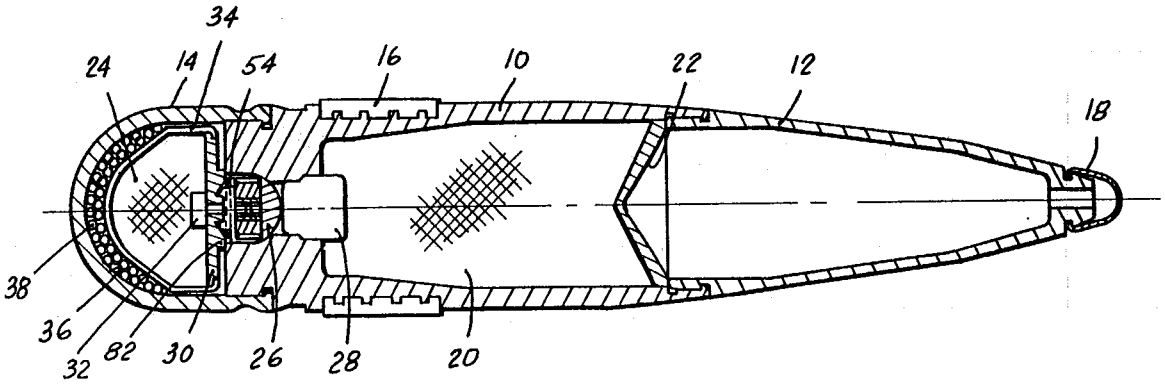
FIG. 5 shows a projectile utilizing the detonator assembly of FIG. 4 in a fuze whose parts are shown in the "Safe" disposition.
Figure 11:
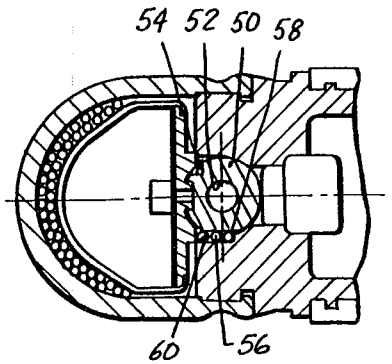
FIG. 11 shows the aft part of FIG. 6 rotated 90°.
Figure 10:
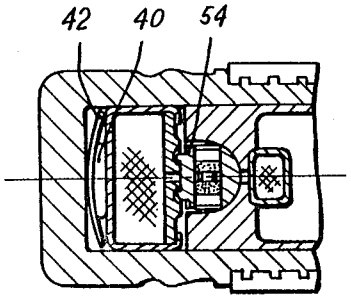
FIG. 10 shows a second alternative arrangement of the aft part of the projectile of FIG. 6.
Figure 9:
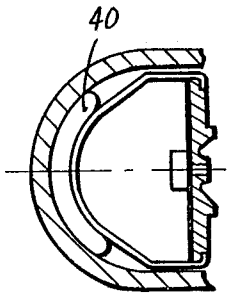
FIG. 9 shows a first alternative arrangement of the aft part of the projectile of FIG. 6.

A projectile or warhead having a detonator assembly embodying this invention is shown in FIG. 5. The projectile includes a main body portion 10, an ogive body portion 12, an aft body portion or fragmenting base cap 14, a rotating band 16, a nose cap 18, a forward high explosive charge 20, a shallow cone liner 22, an aft high explosive charge 24, and a fuze system. The fuze system includes a rotor assembly 26, a forward booster 28, a base locking plate 30, and an aft booster 32 fixed to the plate 30. A cap 34 holds the aft charge 24 to the plate 30, and this assemblage is free to slide fore and aft within the cavity 36 formed by the cap 14. The assemblage is held forward by a volume of flowable dampening material 38 which is shown in FIG. 5 as silicon filled microballoons, in FIG. 9 as a bladder 40 filled with silicon, and in FIG. 10 as a bladder 40 plus a dished spring 42.

The rotor assembly 26 is of the general type shown in U.S. Pat. No. 3,608,494 issued to R. T. Ziemba on Sept. 28, 1971. The assembly includes a ball rotor 50 having a diametral bore 52 therethrough, a C-clip 54, a plurality of balls 56, each disposed partly in a groove 58 in the rotor and partly in a groove 60 in the main body portion 10.

Figure 2:
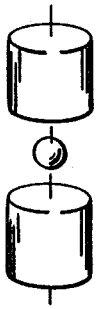
FIGS. 1, 2, 3 and 4 show respective species of detonator assemblies embodying this invention.
Figure 4:
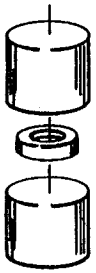
Figure 1:
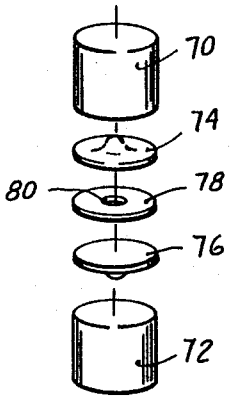
Figure 3:
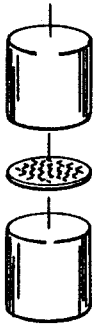

The detonator assembly is disposed within the diametral bore 52 in the rotor 50. This assembly comprises two mechanically initiatable detonators 70 and 72, e.g., M55 stab detonators, spaced apart with their priming ends facing each other. An initiating mechanism 74 is disposed between the detonators. As shown in FIG. 1, this mechanism may comprise two percussion caps 74 and 76 spaced apart by a disk 78 having a flash hole 80 therein. As shown in FIG. 2, the mechanism may comprise a steel ball. As shown in FIG. 3, the mechanism may comprise grit paper. As shown in FIG. 4, the mechanism may comprise a ring, which is the preferred form. The detonators are held within the rotor by means of staking points on the perimeter of the diametral bore of the ball.

The C-clip serves as the primary safety device, in the form of a spin lock for the fuze. The C-clip will not release the ball rotor unless the C-clip is subjected to a high rotational force.

The balls serve as a setback lock. The balls shift aftwardly out of the groove on setback and they fly outwardly into the gap between the forward face of the base plate and the aft face of the main body portion during spin.

The ball rotor is normally aligned with the diametral bore at 90° to the longitudinal or spin axis of the projectile. The detonators can only be initiated after the ball rotor has been unlocked and precessed to align the diametral bore with the spin axis of the projectile. It does not matter which detonator is forward and which is aft. The 90° initial displacement provides the maximum possible precession delay time. However, for those applications where a high friction load on the rotor is encountered, a starting angle of slightly less than 90°, e.g., 87°, will assure precessional movement of the rotor into its aligned disposition, i.e., Armed State.

Initiation also requires that a target be impacted to momentarily compress the priming ends of the detonators onto the initiating mechanism. Projectile setback forces will not initiate the detonators since these forces are at right angles to the priming faces and no loads are applied to them in this attitude.

The plate 30 has a projection 82 which is adapted to interengage either a cup 84 in the ball rotor, or one or the other ends of the diametral bore in the ball rotor.

The operating sequence of the fuze follows:

In the Safe state, as shown in FIG. 5, the ball rotor containing the detonators is locked 90° out of line to the fore and aft boosters by means of the C-clip and the locking balls. Each of these locks precludes rotation of the ball rotor.

Figure 6:
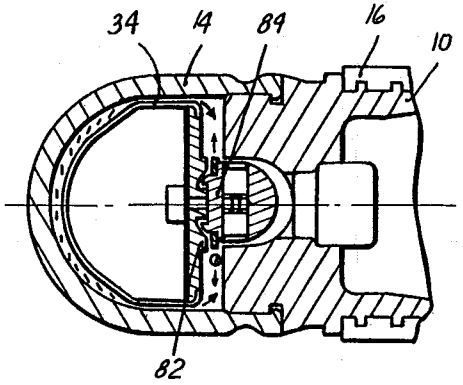
FIG. 6 shows a portion of the projectile of FIG. 5 with the fuze parts shown in the "Set Back" disposition.

At projectile setback, as shown in FIG. 6, the ball rotor with its C-clip and the locking balls, and the aft explosive charge will shift aftwardly. The mass of these components under setback conditions, e.g., 30,000 to 90,000 g's, will rupture the silicon oil filled, plastic microballoons or bladder located aft of the aft explosive charge, causing the oil to flow forwardly into the volume forward of the charge. The ball rotor remains in its out-of-line attitude during setback due to the interengagement of the plate projectile 82 with rotor cup 84. The setback locking balls will be carried aft and fall into the cavity provided by the aftward displacement of the aft explosive charge.

As the projectile advances along the bore and exits the muzzle it develops spin. The centrifugal forces, after muzzle exit, spin the locking balls out to the perimeter of the projectile base cap, where they remain. The centrifugal forces also break the C-clip into two sections which are also spun out to the perimeter of the projectile base cup.

Figure 7:
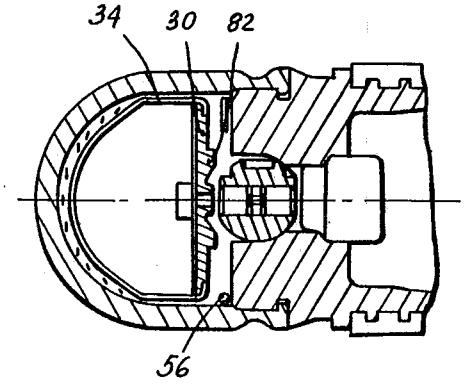
FIG. 7 shows the fuze parts of FIG. 6 in the "Pre-Armed" disposition.
Figure 8:
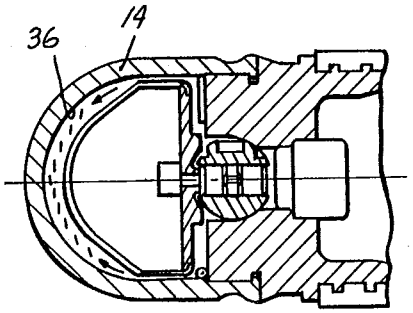
FIG. 8 shows the fuze parts of FIG. 6 in the "Armed and Locked" disposition.

As shown in FIG. 7, the rotor creeps forward back into its own cavity and is free to precess, due to mass unbalance, into its armed state with its diametral bore aligned with the boosters on the spin axis of the projectiles. This precession takes a longer period of time than that of the prior art ball rotors due to the large displacement angle of up to 90°. The direction of precession is immaterial. Creep (set-forward forces) and the compression spring also drive the aft explosive charge forward, but at a rate slower than that of the ball rotor, due to the high viscous dampening forces retarding the movement of the charge. This assures that the rotor will become fully aligned on the projectile spin axis before the plate protusion 82 enters an end of the diametral bore of the ball rotor and locks the rotor in its armed state as shown in FIG. 8.

The detonator assembly, comprising the two detonators and the initiating mechanism are now moved forward slightly within the diametral bore by the plate projection 82 and stop against the aft face of the forward booster charge. In this disposition there still remains a slight gap between the front face of the plate 30 and the aft face of the main body portion. Upon impact, the inertia of the aft high explosive assembly closes this gap abruptly and the plate projection 82 compresses the detonator assembly against the aft face of the main body portion.

In the case of the initiator mechanism shown in FIG. 1, one or the other of the percussion caps will ignite and the shock wave will pass through the flash hole in the disk and ignite the other percussion cap. Each cap will in turn ignite its respective detonator, which will in turn ignite its respective booster, which will in turn ignite its respective high explosive charge.

In the case of the initiator mechanisms shown in FIGS. 2, 3 and 4, the ball or the grit or the ring will directly cause the priming end of each detonator to ignite, which will in turn ignite its respective booster, which will in turn ignite its respective high explosive charge.

The need for an adequate arming delay for the fuze is particularly significant since the warhead employs a fragmenting base here shown as hemispherical. The lethal envelope of such a warhead extends aft of the projectile burst point. This is not the case for conventional base fuzed warheads in which no explosives are contained behind the fuze elements.

Three factors contribute to the arming delay of this fuze design. First, the use of a ball rotor in which the static position of the detonator is up to 90° from the armed position in itself provides a significant delay in the arming of the rotor. In the fuze design herein, a 90° starting angle can be employed since the fuze will function properly regardless of in which direction the rotor aligns. This is because the priming element for the fuze is located between the detonators within the rotor and the output end of each detonator is at the outside face of the ball. Since any slight rotor unbalance or system vibration will cause the rotor to align even in a 90° starting angle condition, arming is assured in this system. The rotor, then, cannot "hang up" at the 90° position as long as rotor cavity friction forces are kept low in rotation to the rotor driving torque. An arming delay in the order of 15 meters is provided by this rotor system.

A second mechanism which contributes to the arming delay in this fuze design is related to the action of the dampening fluid released at projectile setback. After the fluid bladder has been crushed and the fluid displaced forward of the aft explosive charge, a finite period of time is required for the aft explosive charge carrier to move forward before coming to rest against the output end of one of the rotor detonators. The aligning action of the rotor will be faster than the forward displacement motion of the aft explosive charge. If the projectile hits a target before the aft explosive carrier is in contact with the in-line detonators, the fuze will not respond since the inertia of the aft explosive carrier and the rotor will not be transmitted to the detonators. This viscous dampening of the aft explosive carrier, therefore, also contributes to the arming delay of the fuzes.

The fuze mechanization provides a feature whereby the ball rotor is (1) locked into its safe (out-of-line) state during conditions of storage and transportation and (2) locked into its armed state once the rotor has aligned and armed.

In the safe position of the rotor, the protrusion on the forward surface of the aft explosive cap fits into the mating recess in the ball rotor. Since the aft explosive cap is held forward (in the safe mode) by the presence of the fluid pack behind the cap, the rotor cannot turn relative to the fuze body and, therefore, cannot arm. This lock is in addition to the three-ball safing lock located between the rotor and the fuze body.

At projectile setback, the aft explosive charge, together with the ball rotor, move aft against the fluid pack, crushing the pack and allowing the fluid to be displaced forward of the cap. The rotor remains locked to the protrusion on the front surface of the aft explosive cap since the setback g forces are very high during this period. At muzzle exit, however, the ball will "creep" forward, faster than the aft explosive cap, causing the two to separate. Once this occurs, (after the C-spring is released) spin forces align the rotor to its armed state and the detonators are aligned with the booster charges. Shortly thereafter, the extension on the viscous damped aft explosive cap presses against the aft detonator of the rotor assembly locking the rotor and causing it, in turn, to press against the initiator between the detonators. Since this action is not energetic enough to cause the detonators to function, the explosive train remains fixed (locked) in this position until impact. At target impact the inertia of the aft explosive charge rams the detonators together, setting off the percussion charge between them. This in turn functions both detonators, and subsequently, the forward and aft high explosive charges.

It has been determined that the energy necessary to initiate a percussion cap and two detonator arrangement of the configuration shown in FIG. 1 is nominally 20 in/oz (0.104 ft/lbs) using two M55 detonators with their sensitive ends in intimate contact with two percussion caps, separated by a disc spacer.

The effectiveness of an high explosive warhead against personnel targets is greatly increased when the warhead is designed to burst out the rear of the projectile as well as along its cylindrical section. This rearward expulsion of body fragments is particularly effective against standing troop targets when the warhead bursts at ground level. Conventional high explosive warhead shells impacting the ground, on the other hand, result in nearly all of the fragments burying themselves into the ground near the impact point.

The warhead design uses a hemispherical, rear body section in order to provide this increased personnel target effectiveness. The aft explosive charge contained within the hemispherical metal closure cap on the base of the projectile body also serves as the inertial mass used to function the explosive train at target impact. It also serves as the rotor ball lock mechanism in safing and arming the ball rotor within the fuze.

What is claimed is:

1. A detonator assembly comprising:

a pair of primer face to primer face opposed, longitudinally aligned and spaced apart detonators, an initiator mechanism disposed between said primer faces of said detonators, and means for longitudinally compressing said detonators onto said initiator mechanism, wherein said initiator mechanism comprises a pair of percussion caps spaced apart by a disk having a flash hole, and each of said primer faces is stab sensitive.

2. A detonator assembly comprising:

a pair of primer face to primer face opposed, longitudinally aligned and spaced apart detonators, an initiator mechanism disposed between said primer faces of said detonators, and means for longitudinally compressing said detonators onto said initiator mechanism, wherein said initiator mechanism comprises a rigid ball, and each of said primer faces is stab sensitive.

3. An assembly according to claim 2 wherein said rigid ball is made of metal.

4. A detonator assembly comprising:

a pair of primer face to primer face opposed, longitudinally aligned and spaced apart detonators, an initiator mechanism disposed between said primer faces of said detonators, and means for longitudinally compressing said detonators onto said initiator mechanism, wherein said initiator mechanism comprises grit paper, and each of said primer faces is stab sensitive.

5. A detonator assembly comprising:

a pair of primer face to primer face opposed, longitudinally aligned and spaced apart detonators, an initiator mechanism disposed between said primer faces of said detonators, and means for longitudinally compressing said detonators onto said initiator mechanism, wherein said initiator mechanism comprises a rigid ring, and each of said primer faces is stab sensitive.

6. An assembly according to claim 5 wherein said ring is made of metal.

7. A detonator assembly for a projectile comprising:

a pair of primer face to primer face opposed, longitudinally aligned and spaced apart detonators, wherein each of said primer faces is stab sensitive, an initiator mechanism disposed between said primer faces of said detonators, and means for longitudinally compressing said detonators onto said initiator mechanism which comprises a stationary high inertia mass and a movable high inertia mass.

* * * * *